US010663148B1

(12) United States Patent
Heredia

(10) Patent No.: US 10,663,148 B1
(45) Date of Patent: May 26, 2020

(54) MODULAR CHANNEL FOR LINEAR LIGHTING

(71) Applicant: Elemental LED, Inc., Reno, NV (US)

(72) Inventor: Irving Heredia, Reno, NV (US)

(73) Assignee: Elemental LED, Inc., Reno, NV (US)

( * ) Notice: Subject to any disclaimer, the term of this patent is extended or adjusted under 35 U.S.C. 154(b) by 0 days.

(21) Appl. No.: 16/571,413

(22) Filed: Sep. 16, 2019

(51) Int. Cl.

| | |
|---|---|
| ***F21S 4/00*** | (2016.01) |
| ***F21V 15/01*** | (2006.01) |
| ***F21V 21/002*** | (2006.01) |
| ***F21V 21/35*** | (2006.01) |
| *F21Y 103/10* | (2016.01) |
| *F21Y 115/10* | (2016.01) |

(52) U.S. Cl.
CPC ..... *F21V 15/013* (2013.01); *F21V 21/002* (2013.01); *F21V 21/35* (2013.01); *F21Y 2103/10* (2016.08); *F21Y 2115/10* (2016.08)

(58) Field of Classification Search
CPC ..... F21V 15/013; F21V 21/35; F21V 21/002; F21Y 2115/10; F21Y 2103/10
USPC ..... 362/217.1
See application file for complete search history.

(56) References Cited

U.S. PATENT DOCUMENTS

| | | | | |
|---|---|---|---|---|
| 6,481,130 | B1 | 11/2002 | Wu | |
| 7,111,957 | B2 | 9/2006 | Bernhart et al. | |
| 7,758,207 | B1 * | 7/2010 | Zhou | F21S 8/06 362/218 |
| 7,854,527 | B2 * | 12/2010 | Anderson | F21V 3/00 362/133 |
| 8,061,865 | B2 | 11/2011 | Piepgras et al. | |
| 8,092,038 | B2 * | 1/2012 | Liao | F21V 19/004 362/217.1 |
| 8,459,824 | B1 * | 6/2013 | Esmailzadeh | F21S 8/026 362/147 |
| 8,616,757 | B2 | 12/2013 | Leadford et al. | |
| 8,651,689 | B2 * | 2/2014 | Que | F21V 15/013 362/217.1 |

(Continued)

FOREIGN PATENT DOCUMENTS

KR 101406244 B1 6/2014

OTHER PUBLICATIONS

U.S. Appl. No. 16/571,413, filed Sep. 16, 2019, Elemental LED, Inc.

(Continued)

*Primary Examiner* — Ali Alavi
(74) *Attorney, Agent, or Firm* — United IP Counselors, LLC

(57) ABSTRACT

Modular channels are disclosed. The channels include a pair of sidewalls and a channel bottom. The pair of sidewalls and the channel bottom are separate, modular, and connected at or proximate to the sidewall bottoms by complementary engaging structures carried by the parts. In some cases, an intermediate member may be placed in the joints between the bottom and the sidewalls. The intermediate member may be made of plastic or rubber, and typically has a constant cross section. It may be a tube or have a round or ellipsoid cross section. The sidewalls may have flanges for flush-mounting the channel in a wall or similar structure. The sidewalls and bottom may carry various channels for alignment with other channels or mounting on other structures.

21 Claims, 12 Drawing Sheets

(56) References Cited

U.S. PATENT DOCUMENTS

| | | | | |
|---|---|---|---|---|
| 8,870,407 | B2 * | 10/2014 | Kim | F21S 8/02 362/217.1 |
| 8,888,306 | B2 * | 11/2014 | Thomas | F21V 15/013 362/92 |
| 8,992,045 | B2 | 3/2015 | Veerasamy et al. | |
| 9,279,544 | B1 | 3/2016 | Dankelmann et al. | |
| 9,512,984 | B2 | 12/2016 | Tessnow et al. | |
| 9,897,294 | B2 | 2/2018 | Pearson et al. | |
| 9,933,123 | B2 | 4/2018 | Ladstätter | |
| 10,190,738 | B1 * | 1/2019 | James | F21V 19/004 |
| 2003/0021116 | A1 | 1/2003 | Miller et al. | |
| 2007/0019409 | A1 | 1/2007 | Nawashiro et al. | |
| 2008/0266843 | A1 * | 10/2008 | Villard | E04B 9/32 362/147 |
| 2009/0168419 | A1 | 7/2009 | Daimon | |
| 2011/0286207 | A1 | 11/2011 | Chan et al. | |
| 2012/0092852 | A1 | 4/2012 | Doan et al. | |
| 2012/0120667 | A1 | 5/2012 | Schenkl | |
| 2013/0308303 | A1 * | 11/2013 | Greenholt | F21V 33/006 362/150 |
| 2014/0049939 | A1 | 2/2014 | Kuenzler et al. | |
| 2014/0226316 | A1 * | 8/2014 | Medendorp, Jr. | F21S 8/043 362/147 |
| 2014/0252249 | A1 | 9/2014 | Doros et al. | |
| 2015/0159833 | A1 | 6/2015 | Qiu et al. | |
| 2016/0076746 | A1 * | 3/2016 | Porciatti | F21V 29/76 362/404 |
| 2016/0138777 | A1 | 5/2016 | Shen et al. | |
| 2018/0245754 | A1 | 8/2018 | Gensler et al. | |
| 2019/0088241 | A1 | 3/2019 | Czech et al. | |
| 2019/0285244 | A1 | 9/2019 | Hawks et al. | |

OTHER PUBLICATIONS

U.S. Appl. No. 16/571,537, filed Sep. 16, 2019, Elemental LED, Inc.

U.S. Appl. No. 16/571,675, filed Sep. 16, 2019, Elemental LED, Inc.

Elemental LED, Inc., "Tape Light Mounting Channels," 2019 Diode LED Catalog, pp. 45-56, Jan. 2019.

* cited by examiner

MODULAR CHANNEL FOR LINEAR LIGHTING

TECHNICAL FIELD

The invention relates to linear lighting, and to modular channels for linear lighting.

BACKGROUND

Over the last 15 years, household and commercial lighting based on LEDs has become increasingly dominant in the marketplace, supplanting traditional incandescent and fluorescent luminaires. Linear lighting, one particular form of LED lighting, typically includes a thin, elongate printed circuit board (PCB) populated with a number of LED light engines, usually spaced at a regular pitch. The PCB may be either flexible or rigid.

One of the most popular ways of using linear lighting is to install it in a channel and cover it with a cover. The channel offers protection, and the cover typically acts as a diffuser, spreading the light and improving the overall appearance, although covers may be used for a wide variety of protective and beam-shaping purposes. The result is a finished luminaire suitable for installation in a variety of locations.

Examples of channels used with linear lighting can be found in U.S. Pat. No. 9,279,544, the contents of which are incorporated by reference in their entirety. The typical channel for linear lighting is a single-piece extrusion, made of metal or plastic, that has a pair of sidewalls and a bottom. The sidewalls of some channels have outwardly-extending flanges, which are typically used for flush-mounting the channels in walls.

BRIEF SUMMARY

Aspects of the invention relate to modular and multipurpose channels, and to covers for those channels.

One aspect of the invention relates to a modular channel. The channel comprises separate sidewalls and a channel bottom that are connectable by complementary engaging structure. The engaging structures may be of any of a number of different constructions, and an intermediate member may be interposed in the joints between the sidewalls and the bottom. The intermediate member may be, e.g., a plastic or rubber piece of constant cross section, typically either a tube or a solid piece with a round or ellipsoid cross section. The sidewalls may each have an outwardly-extending flange, and the outer surfaces of the sidewalls and the undersides of the flanges may carry flutes. A groove may lie at the junction between the sidewall and its flange. The underside of the channel bottom may carry any number of grooves or channels, for alignment or for mounting. In some cases, the sidewalls may extend at generally right angles to the channel bottom; in other cases, the sidewalls may diverge outwardly from the channel bottom. One embodiment according to this aspect of the invention relates to a luminaire that includes a channel as described above, linear lighting installed in the channel, and a cover installed on the channel.

Another aspect of the invention relates to a channel adapted to diffuse light. The channels include a bottom and a pair of sidewalls. The interior surfaces of the sidewalls are free from inward projections or ridges that would prevent light from linear lighting installed in the channel from reaching the cover. In some cases, the sidewalls may bend inwardly to capture and engage the cover. In various embodiments, the cover may be a diffuser, a lens, or a prism. In some cases, the bottom of the channel may be sloped or angled to direct the light from linear lighting installed on it.

Yet another aspect of the invention relates to multipurpose channels. These channels include sidewalls and a bottom, which may be either modular or of single-piece construction. An outwardly-extending flange is removably connected to at least one sidewall, allowing the channel to be mounted flush in a wall or converted for mounting in another fashion.

Other aspects, features, and advantages of the invention will be set forth in the description that follows.

BRIEF DESCRIPTION OF THE DRAWING FIGURES

The invention will be described with respect to the following drawing figures, in which like numerals represent like features throughout the figures, and in which.

DETAILED DESCRIPTION

Figure 1:
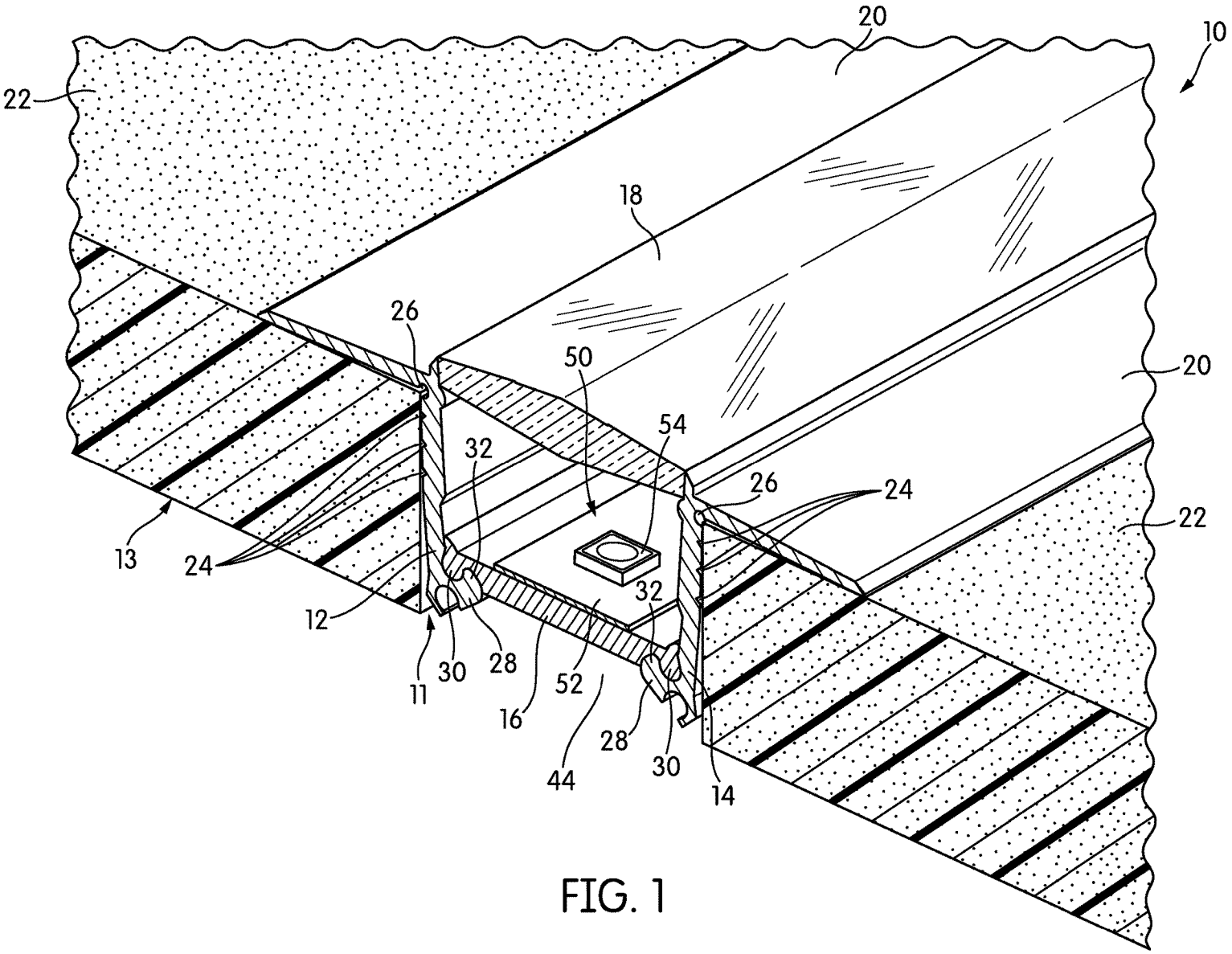
FIG. 1 is a cross-sectional perspective view of a channel with linear lighting, shown as installed in a portion of a wall.

FIG. 1 is a cross-sectional perspective view of a channel with linear lighting, generally indicated at 10, according to one embodiment of the invention. In the view of FIG. 1, the channel 10 is shown flush-mounted in a slot 11 within a wall 13. The channel 10 has sidewalls 12, 14 and a bottom 16. A cover 18 covers the channel 10. As will be described below in more detail, the sidewalls 12, 14 and the bottom 16 are separate, modular components that are connected together to form the channel 10.

In the illustrated embodiment, the sidewalls 12, 14 are mirror images of one another and the bottom 16 is symmetrical about its longitudinal centerline. However, the sidewalls 12, 14 need not be mirror images of one another, and the bottom need not be symmetrical. In the following description, it is assumed that the channel 10 has a constant cross-sectional shape over its entire length. The sidewalls 12, 14 and bottom 16 would typically be made by extrusion of a metal or plastic, such as aluminum, polycarbonate, or ABS, although these components could be made by casting, machining, or other such formation processes. The precise material that is used will usually depend on the application: metal channels provide rigidity, thermal conductivity, and longevity, but for certain applications, the lower weight and lower cost of plastic channels may be helpful.

Figure 2:
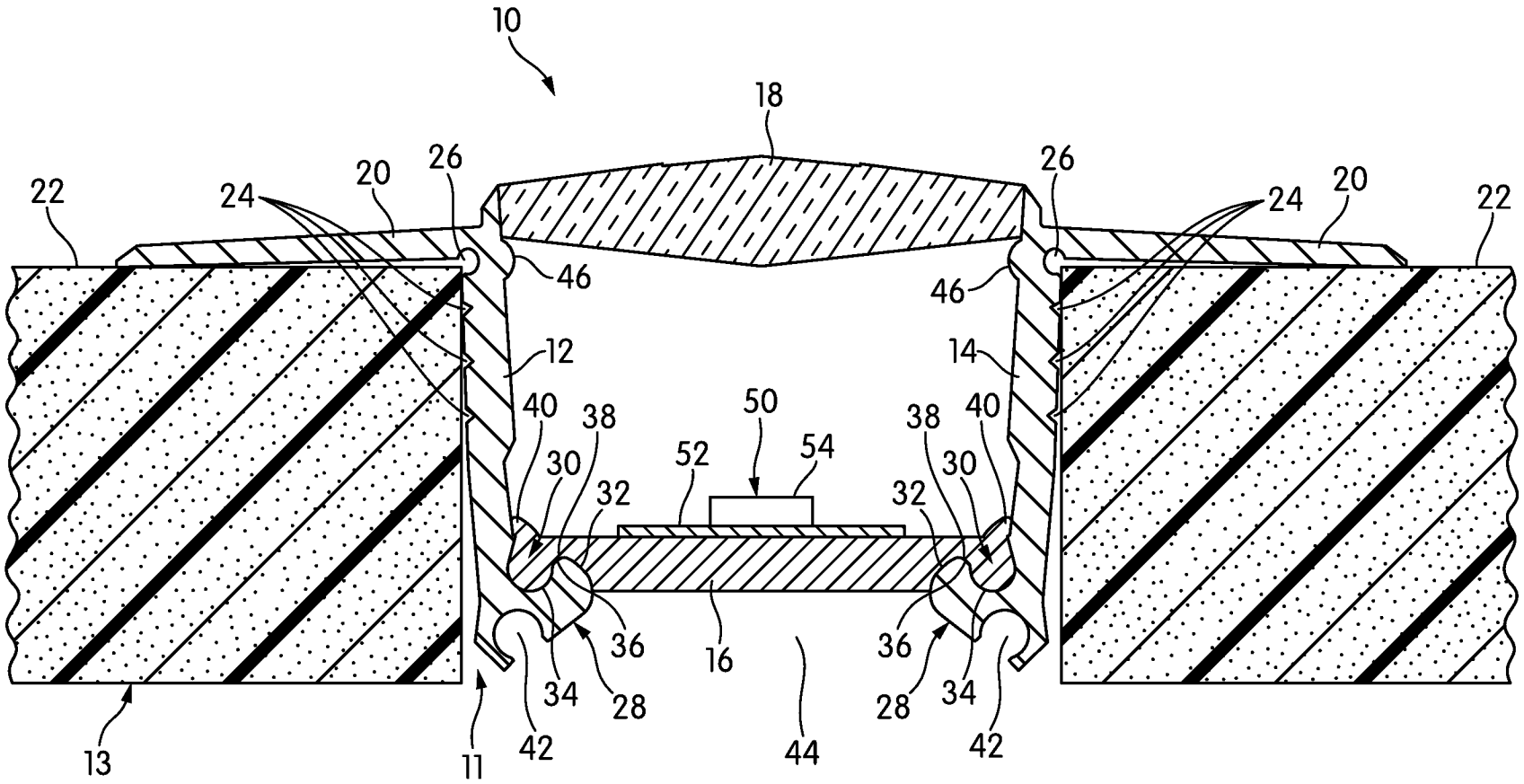
FIG. 2 is a cross-sectional view of the channel of FIG. 1.

As shown in FIG. 1 and in FIG. 2, a cross-sectional view, the channel 10 is designed for flush-mounting in walls. To that end, each sidewall 12, 14 turns outwardly approximately 90°, forming a side flange 20. Installed, the flanges 20 rest overtop the wall surfaces 22 on either side of the slot 11, with the sidewalls 12, 14 and bottom 16 of the channel 10 recessed behind the wall surfaces 22. As shown, the flanges 20 sit slightly below the tops of the sidewalls 12, 14, forming a slight lip 21 between the flanges 20 and the tops of the sidewalls 12, 14.

In many installations, a joint compound, or another type of adhesive, is used to secure the channel 10 to the wall surfaces 22 and, more generally, within the slot 11. Thus, while FIGS. 1 and 2 show the flanges 20, in actual installations, the flanges 20 may be covered by layers of joint compound, paint, and other such things.

The channel 10 of the illustrated embodiment has structure to improve adhesion when installed in a traditional way with a joint compound. Specifically, the undersides of the flanges 20 and the outer surfaces of the sidewalls 12, 14 carry flutes 24 that provide additional surface area for a joint compound or other adhesive to secure the channel 10 within the wall surfaces 22. Additionally, at each joint between the sidewall 12, 14 and the flange 20, a groove 26 is formed. The groove 26 provides space for the joint compound to flow into, and may provide better adhesion between the channel 10 and the wall surfaces 22.

Toward their lower ends, opposite the flanges 20, each sidewall 12, 14 carries engaging structure 28 for engaging with the bottom 16. On each side, the bottom 16 carries complementary engaging structure 30. The engaging structure 28 may be male or female, or it may have both male and female elements. Similarly, the complementary engaging structure 30 may be male, female, or have both male and female elements. In most cases, the complementary engaging structures 28, 30 will offer at least a tight fit, and in some cases, they may be physically interengaged. Preferably, the complementary engaging structures 28, 30 are such that the sidewalls 12, 14 and bottom 16 can be pushed together to engage, snapped together, or slid together, depending on the embodiment.

As shown in FIG. 2, each of the sidewalls 12, 14 of the illustrated embodiment has an inwardly-extending flange that serves as the engaging structure 28. The flange 28 terminates in a bulbous projection 32 that extends upwardly, at an angle to vertical, and creates an upwardly-opening, at least semicircular groove 34 in the flange 28. A complementary projection on each side of the bottom 16 serves as the complementary engaging structure 30. The main extent of the projection 30 matches the shape of the groove 34 and rests in it. The upper tip 36 of the bulbous projection 32 rests in a complementary notch 38 provided in the underside of the bottom 16. Thus, the bottom 16 and each sidewall 12, 14 are interengaged by at least a tight fit. An upper portion 40 of the complementary projection 30 on the bottom 16 extends upwardly and to the side, resting flush with the inner surface of the sidewall 12, 14.

As is also shown in FIG. 2, the sidewalls 12, 14 and bottom 16 may form other engaging structures that may be used to connect the channel 10 with other structures. In the illustrated embodiment, each flange 28 also carries a downwardly-opening at least semicircular groove 42 for this purpose. These grooves 42 may be used, for example, to hold alignment pins that are used to align and join multiple sections of the channel 10 together.

If the bottom 16 is narrow and light, the engagement with the sidewalls 12, 14 may be sufficient to hold it in place when the channel 10 is in use. However, if the bottom 16 is wider or made of a particularly heavy material, some additional mode of securement may be helpful in keeping the bottom 16 in position. For that reason, and as will be described below in more detail, the bottom 16 may include slots, channels, or grooves allowing it to mount directly to fixed structures in or on a wall, or in other locations. More generally, the channel 10 as a whole may be made to use any kind of standard channel mounting clip, including spring-loaded mounting clips that allow the channel 10 to be snapped into a desired position.

As can be appreciated from FIG. 2, there is some space 44 between the underside of the bottom 16 and the lower ends of the sidewalls 12, 16. This space 44 may be used as a raceway for wiring that powers or controls the linear lighting 50.

Linear lighting 50 is disposed on the upper surface of the bottom 16. The linear lighting 50 has a printed circuit board (PCB) 52 on which are disposed one or more LED light engines 54, typically spaced at a regular pitch along the length of the PCB 52. Beyond that, the linear lighting 50 may be of any type. More specifically, it may accept either low voltage or high voltage; it may have a flexible printed circuit board (PCB) or a rigid one; it may be either bare or encapsulated; it may accept either AC power or DC power; and it may emit one color or a plurality of colors. As for the operating voltage of the linear lighting, while the definitions of "low voltage" and "high voltage" vary depending on the authority one consults, for purposes of this description, voltages over about 50V will be considered to be high voltage. High voltage typically brings with it certain requirements, for example, that the linear lighting in question be encapsulated by an electrical insulator. Even if the linear lighting 50 is low voltage, encapsulation may give the linear lighting 50 greater ingress protection, making it more resistant to dirt, water, and the elements.

The bottom 16 of the channel 10 may be ruled or grooved along its length as a guide for alignment of the linear lighting 50 while it is installed. A portion of the bottom 16 may also be recessed or include a shallow trough in some embodiments in order to make alignment and installation of the linear lighting 50 easier. In the channel 10 of FIG. 2, the bottom 16 includes a groove 56 along its longitudinal centerline. The groove 56 provides a visual reference point for aligning the linear lighting 50 during installation.

Of course, the linear lighting 50 need not always be installed on the bottom 16. In some cases, linear lighting 50 could be installed on one of the sidewalls 12, 14. This is typically done to increase diffusion by reflecting the light from the linear lighting 50 off of the opposite sidewall 12, 14 before it exits the channel 10 through the cover 18.

The upper interior portions of the sidewalls 12, 14 may have any structure, such as grooves, recesses, or flanges, that is necessary or desirable for the mounting of the cover 18. The cover 18, typically made of transparent or translucent plastic, serves to protect the linear lighting 50 and, in most cases, to diffuse the light from the linear lighting 50 as it exits the channel 10. Alternatively, as in the present case, the fit between the cover 18 and the sidewalls 12, 14 may be frictional and based on the relative sizes of the components.

Figure 3:
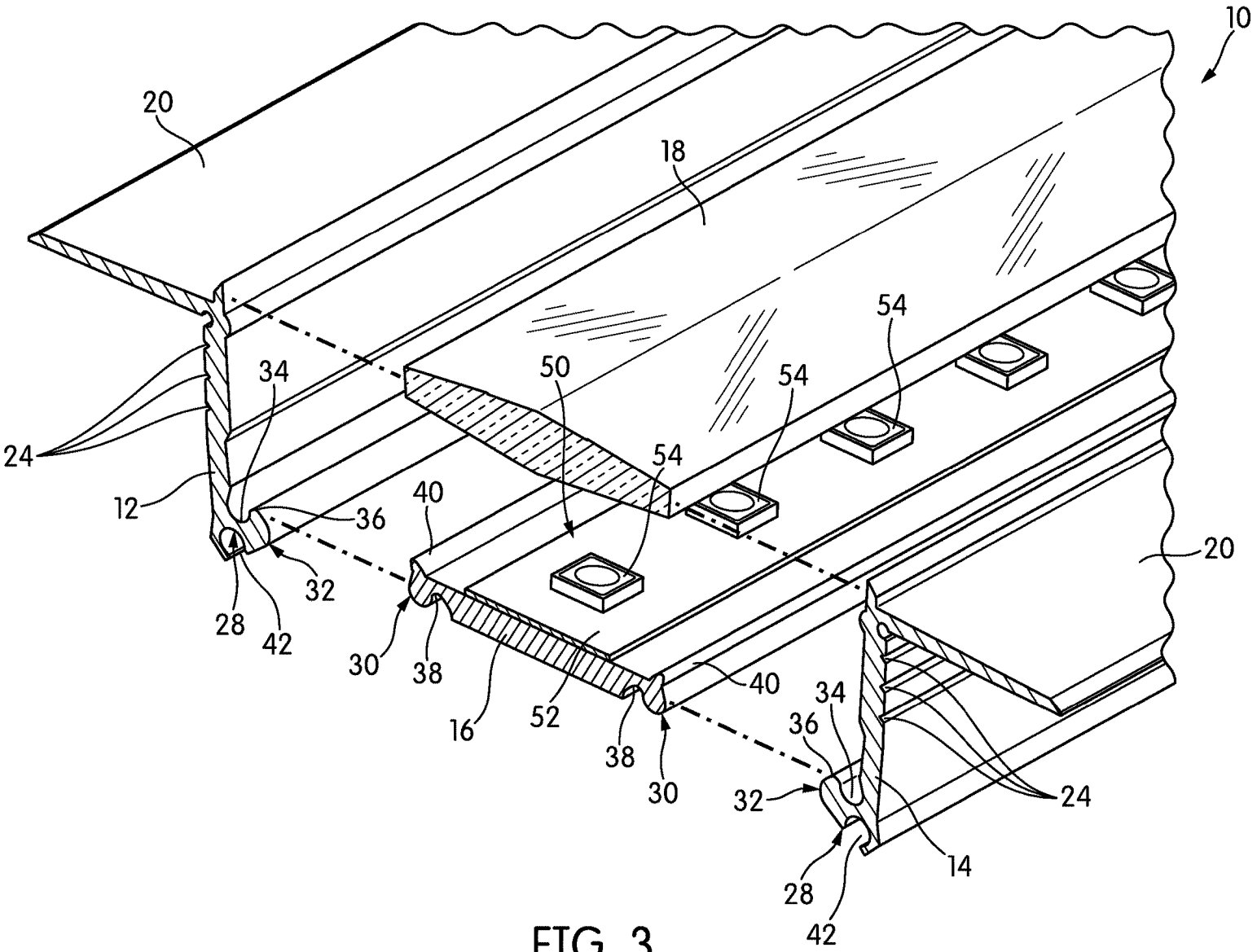
FIG. 3 is an exploded perspective view of the channel of FIG. 1.

FIG. 3 is an exploded perspective view of the channel 10, showing its components and their assembly. As was described briefly above, the connection between the sidewalls 12, 14 and the bottom 16 is such that they can be mated with one another without tools, e.g., by snapping or pushing the bottom 16 in place relative to the sidewalls 12, 14 or by sliding them together. Different modes of engagement may be used depending on the application for which the channel 10 is intended.

The modular construction of the channel 10 has certain advantages. For one, the channel 10 may be as wide and as deep as it needs to be for any given application by using different sidewalls 12, 14, a different bottom 16, or in some cases, two different sidewalls 12, 14. The modular construction of the channel 10 may also make installation simpler.

As one example of a possible installation procedure, an installer could make an appropriate opening in a wall or drywall panel, and then install the two sidewalls 12, 14 on either side of the opening. The installation of the sidewalls 12, 14 could follow traditional steps, including preparing or priming the surfaces of the flanges 20 to remove any oxides or contaminants, and then mudding them in with a joint compound. If the channel 10 has a lip 21, it may make it easier for the installer to mud in the channel 10, because the lip 21 provides a stop and dam for the joint compound, preventing it from flowing over into the area of the cover 18 or into the channel 10. In some cases, the channel 10 may be covered with a dummy cover 18 during the mudding-in process in order to protect the inner surfaces of the sidewalls 12, 14.

The flutes 24 and grooves 26 provide space and additional surface area to allow for better adhesion to the wall surface 22. Additionally, as can be appreciated especially from FIG. 2, the sidewalls 12, 14 themselves cant inwardly as they extend into the wall 13, such that the sidewalls 12, 14 are farther from the edges of the slot 11 in the wall 13 toward the bottom. This may also provide clearance for joint compound to flow between the channel 10 and the slot 11.

With the sidewalls 12, 14 installed in an opening in a wall, the linear lighting 50 can be mounted on the bottom 16 separately. Many strips of linear lighting 50 are backed by pressure-sensitive adhesive and the installation process may involve cleaning and priming the surface of the bottom 16 to receive the linear lighting 50 and then installing the linear lighting 50 using the pressure-sensitive adhesive. The bottom 16, with linear lighting 50 installed, can then be mated with the already-installed sidewalls 12, 14, and the channel 10 closed by positioning the cover 18 in the space between the top edges of the sidewalls 12, 14. If necessary, prior to installation of the bottom 16 in the sidewalls 12, 14, holes may be drilled to allow passage of wires. In many cases, the linear lighting 50 may be fully wired before the bottom 16 is installed in the sidewalls 12, 14.

Figure 4:
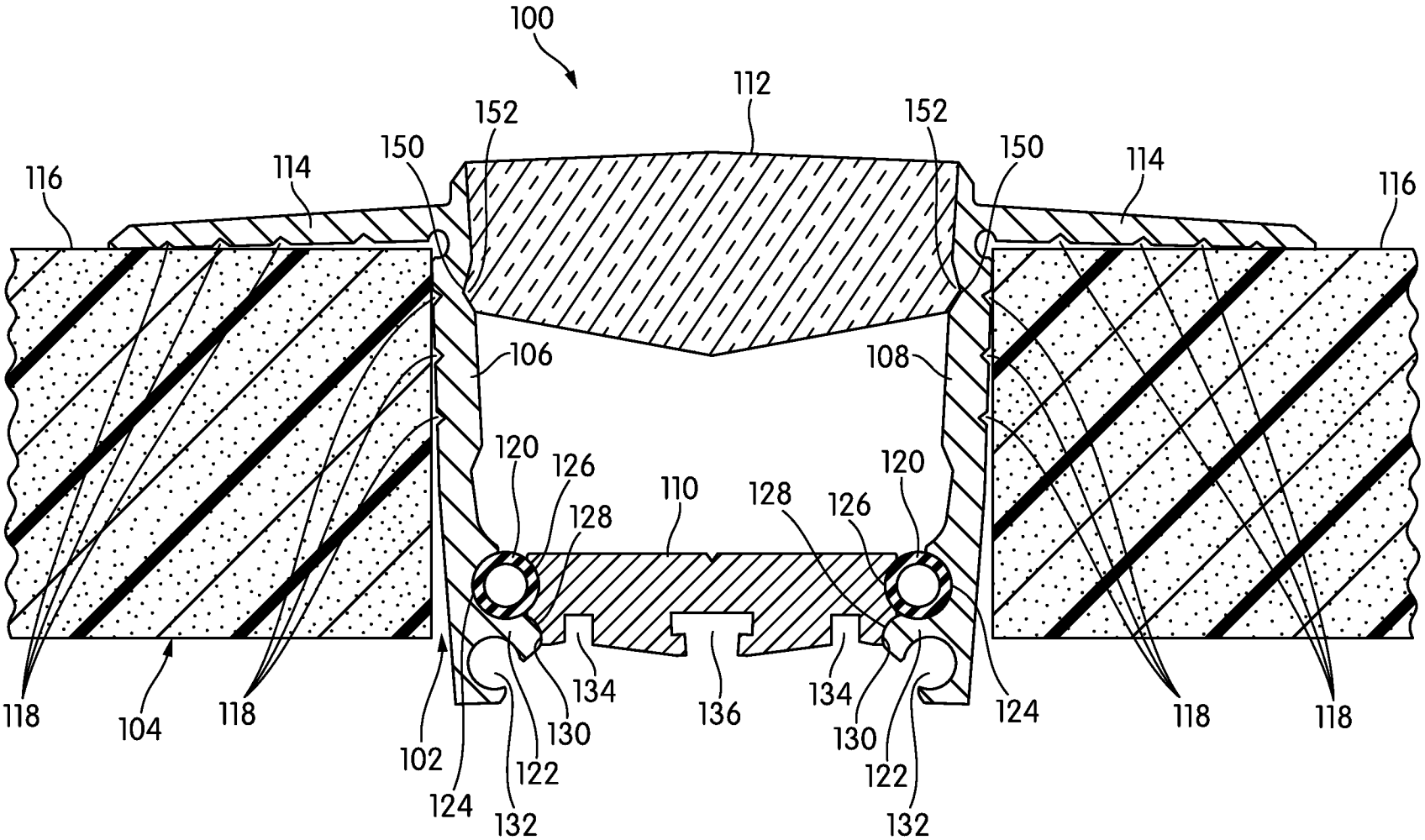
FIG. 4 is a cross-sectional view of a channel according to another embodiment of the invention, illustrating the use of an intermediate member interposed between modular sidewalls and bottom.

FIG. 4 is a cross-sectional view of a channel, generally indicated at 100, shown installed in a slot 102 within a wall 104. The structure of the channel 100 is similar to that of the channel 10 described above: a modular, separable pair of sidewalls 106, 108 and a bottom 110. A cover 112 covers the channel. Toward their tops, the sidewalls 106, 108 have flanges 114 that extend outward and rest along the outer surfaces 116 of the wall 104. The undersides of the flanges 114 and the outer surfaces of the sidewalls 106, 108 have flutes 118 to allow for better adhesion with a joint compound.

The channel 100 of FIG. 4 differs from the channel 10 described above in the manner in which the bottom 110 engages with the sidewalls 106, 108. In the channel 10 described above, the sidewalls 12, 14 mate directly with the bottom 16. However, that need not be the case in all embodiments. In the channel 100, an intermediate member 120 acts as an interface between the sidewalls 106, 108 and the bottom 110.

The intermediate member 120 of FIG. 4 is a round plastic or rubber tube that runs the length of the channel 100. For example, the intermediate member 120 may be made of nylon, high-density polyethylene, or the like. The intermediate member 120 is partially supported by an inwardly-extending flange 122 formed at the bottom of each sidewall 106, 108. Specifically, a channel 124 formed in the flange 122 matches the curvature of the intermediate member 120 and surrounds about half of its circumference. A curved groove 126 on each side of the bottom 110 presses against and partially supports the intermediate member 120 as well. A top portion of the intermediate member 120 is exposed.

The presence of an intermediate member 120 may make the structure of the engaging structures of the sidewalls 106, 108 and the bottom 110 less complex, it may make dimensioning and tolerancing easier, it may seal the joint against the intrusion of moisture and debris, and it may add some elasticity or resilience to the joint. However, as can be seen in FIG. 4, the sidewalls 106, 108 and the bottom do engage directly over at least a portion of their interface. Specifically, the bottom 110 has a second curved groove 128 below the groove 126 that bears against the intermediate member 120. The two grooves 126, 128 form a sharp angle between them. A bulbous ridge 130 on the inner edge of the flange 122 bears against the second, lower groove 128 on the bottom 110.

Although an intermediate member 120 is present, the engagement of the sidewalls 106, 108 and the bottom 110 is still such that the two components can be pushed together. If the intermediate member 120 is at least slightly elastic, its resilience may help to hold the components 106, 108, 110 together.

The channel 100 includes slightly different structure for mounting. Each of the sidewalls 106, 108 carries a circular groove 132 along its bottom edge. The grooves 132 open somewhat inwardly. These grooves 132 may be used for alignment pins, to line up adjacent channels 100 in long runs, or they may be used with clips or other such mounting structure. The bottom 110 carries a pair of rectangular grooves 134 along its underside, spaced equidistant from its horizontal centerline, that provide places for clips to engage. The bottom 110 also forms a T-slot that, as was described above, allows the bottom to engage an external surface for support along its length.

Figure 5:
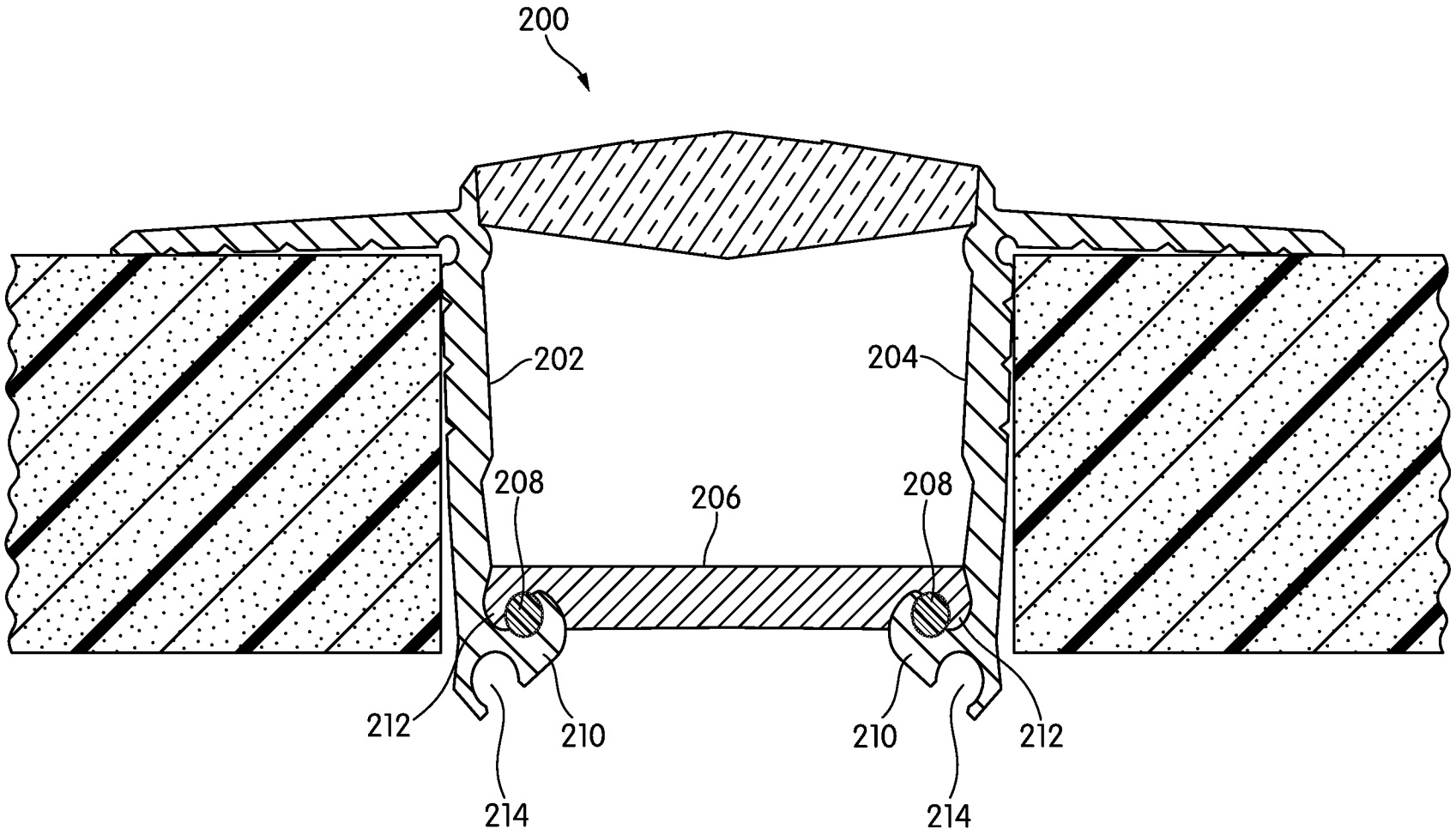
FIG. 5 is a cross-sectional view of a channel according to another embodiment of the invention, illustrating the use of a different type of intermediate member interposed between modular sidewalls and bottom.

Intermediate members may have may different shapes and sizes, as needed to complement the engaging structures on the sidewalls and bottom. FIG. 5 is cross-sectional view of a channel, generally indicated at 200, according to another embodiment of the invention. The channel 200 of FIG. 5 is generally similar to the channel 100 described above; therefore, parts not described here should be considered to be similar to those described above.

In the channel 200 of FIG. 5, the sidewalls 202, 204 and the bottom 206 are connected together with an intermediate member 208 in each joint. In this case, the intermediate member 208 is a solid strip of plastic or rubber that is slightly ellipsoid in cross-sectional shape. Each sidewall 202, 204 defines a wide, inwardly-extending flange 210 that, at its furthest inward extent, curves sharply upward, back toward its sidewall 202, 204, partially encircling the intermediate member 208. A similar, sharply curved downward projection 212 on each side of the bottom 206 engages the portion of the flange 210 closer to the sidewall and partially encircles the intermediate member 208 from the other side. Thus, the intermediate member 208 is fully encircled by the complementary engaging structures 210, 212 of the sidewalls 206, 208 and bottom. The connection between the sidewalls 202, 204 and bottom 206 is a push-fit; the components can be pushed together into engagement, typically without tools.

Each sidewall also defines a downwardly-opening channel 214 at its lowermost extent, which may be used for alignment pins, clips, or to attach to other structures. However, unlike the channel 100 described above, the bottom 206 does not carry any additional structure for attachment.

Figure 6:
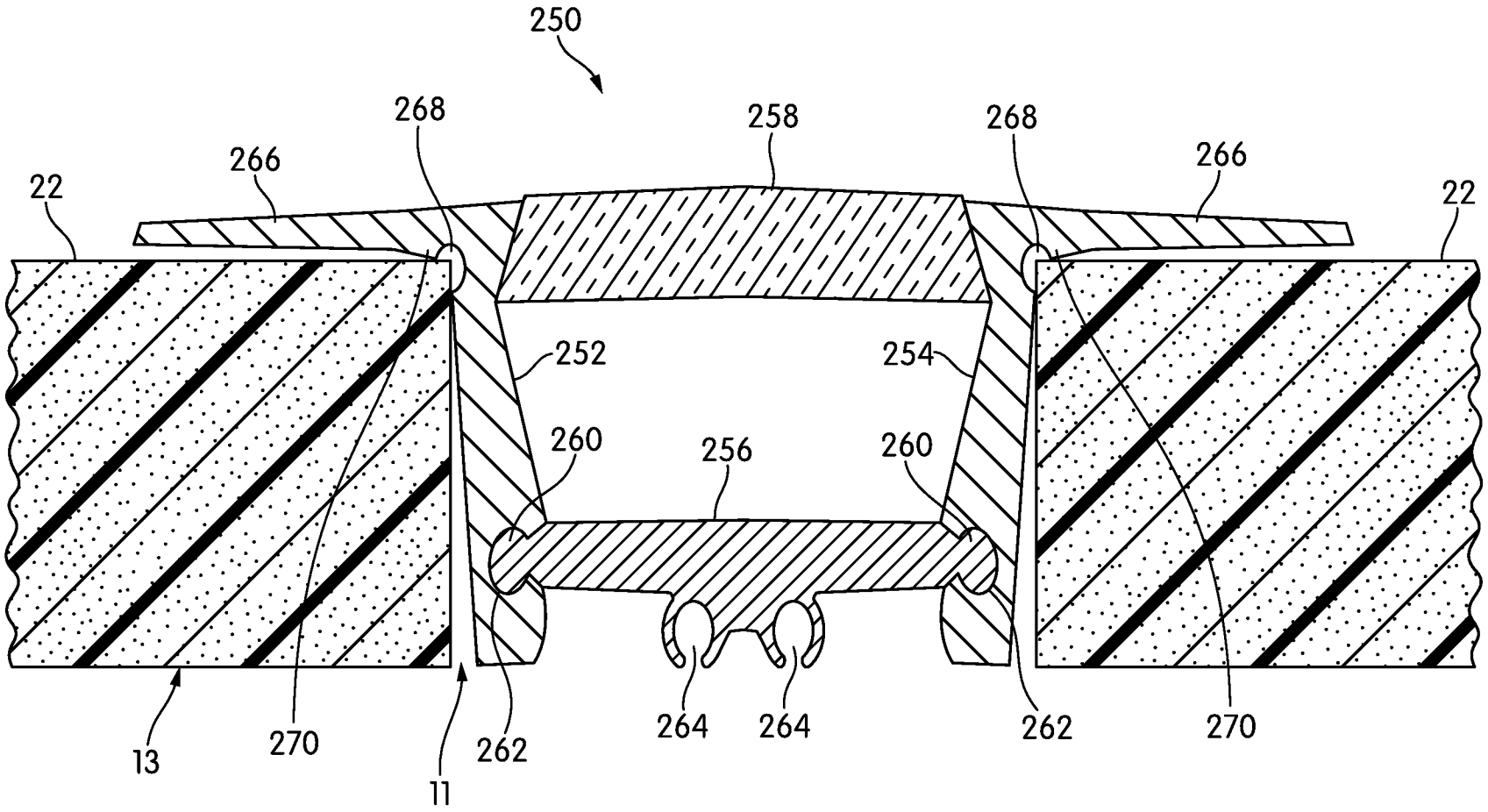
FIG. 6 is a cross-sectional view of a channel according to yet another embodiment of the invention.

FIG. 6 is a cross-sectional view of a channel, generally indicated at 250, according to yet another embodiment of the invention. The channel 250 has a pair of sidewalls 252, 254 modularly connected to a bottom 256. The channel 250 is covered by a cover 258.

The connection between the sidewalls 252, 254 and the bottom 256 is a direct connection, without any intermediate member. More specifically, the connection is a tab-and-slot connection, much like a jigsaw puzzle, with the tabs 260 carried at the side edges of the bottom 256 and the slots 262 carried by the sidewalls 262. This is a slide-together configuration; the channel 250 will typically be assembled by sliding the bottom 256 into the slots 262 in the two sidewalls 252, 256.

The bottom defines two channels 264 that project downwardly from its underside. Each channel 264 is elliptical in cross-section. The space between the bottom 256 and the lower ends of the sidewalls 252, 254 serves as a raceway for wiring, as in the other embodiments described above.

The channel 250 also has somewhat different sidewall shapes than the embodiments described above. More specifically, the sidewalls 252, 254 have almost entirely straight, angled sides above the bottom 256. The flanges 266, which project outwardly from their respective sidewalls, also have straight, angled sides. Grooves 268 are formed at the joint between the main vertical extent of the sidewall 252, 254 and the generally horizontal flange 266. Compared with the other embodiments, the grooves 268 are larger, providing more space for joint compound or other mounting agents to flow in and engage the channel 250.

Unlike in the embodiments described above, neither the sidewalls 252, 254 nor the flanges 266 carry flutes to improve adhesion. Instead, the channel 250 is simply shaped to leave more surface area accessible. Specifically, each flange has a slight, relatively sharp ridge 270 on its underside, close to the joint with the main extent of the sidewall 252, 254. The ridges 270 hold the flanges 266 slightly away from the wall surfaces 22, creating gaps between the two that extend almost the entire width of the flanges 266.

Behind the wall, the sidewalls 252, 254 both cant inwardly and thicken, reaching their greatest thickness at the position of the slots 262 that accept the bottom 256. The added thickness provides space for the tabs 260, while the inward cant provides a larger gap between the slot 11 and the sidewalls 252, 254.

Figure 7:
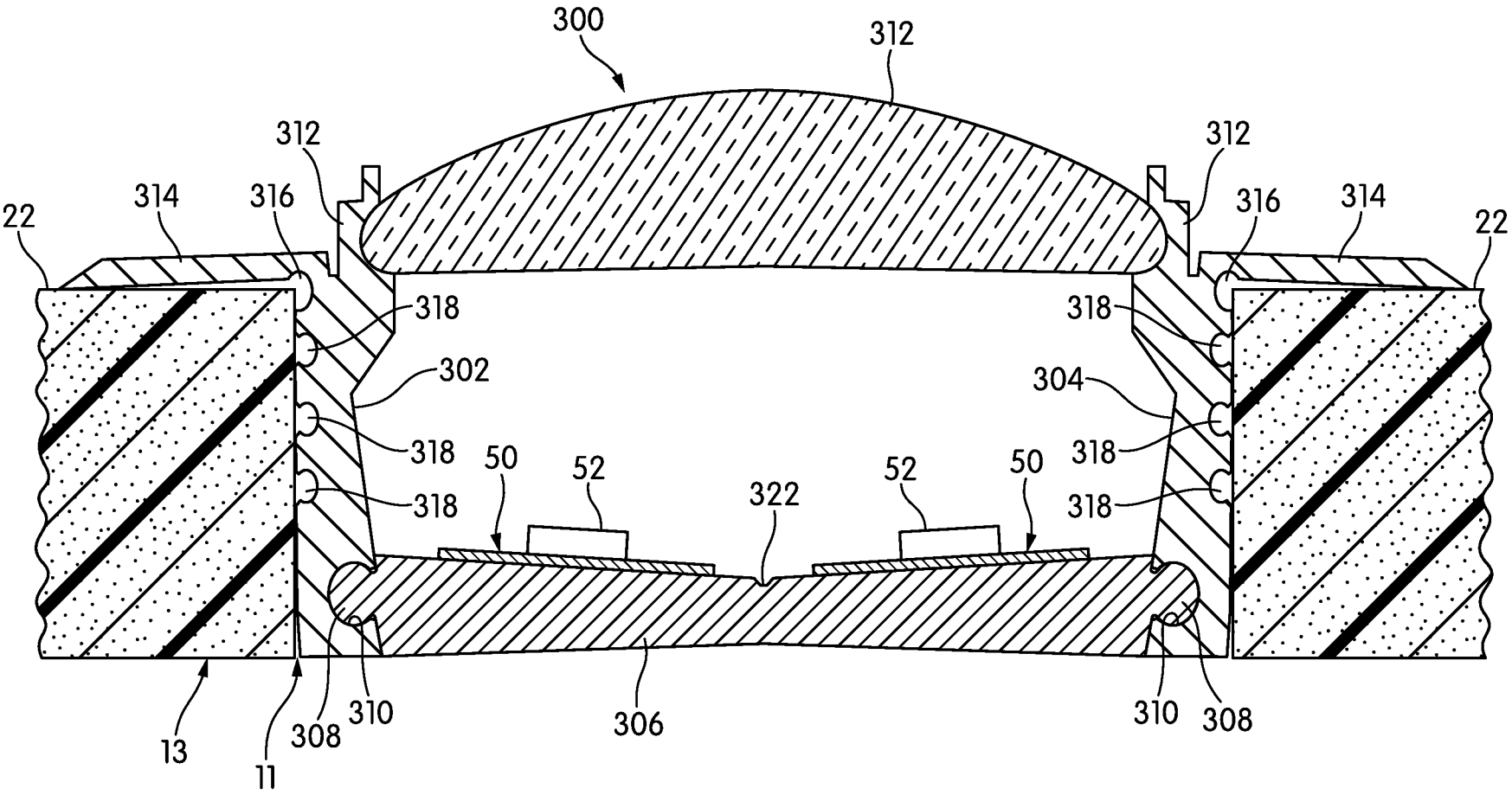
FIG. 7 is a cross-sectional view of a channel according to a further embodiment of the invention, illustrating the use of multiple strips of linear lighting in a single channel and a base that is shaped to direct the light from the strips of linear lighting.

FIG. 7 is a cross-sectional view of a channel, generally indicated at 300, that represents a variation on several embodiments described above. As with the other embodiments, the sidewalls 302, 304 connect modularly to a bottom 306. As with the channel 250 described above, the connection between the sidewalls 302, 304 and the bottom 306 is a tab-and-slot connection, with the bottom carrying the tabs 308 and the sidewalls 302, 304 having slots 310, although that may be reversed in other embodiments.

The profile of the sidewalls 302, 304 differs significantly from those of the other embodiments. The cover 312 has the form of a plano-convex lens, as will be described below in greater detail, and is supported by a pair of brackets 312, one on each sidewall 302, 304 that sit beyond the level of the flanges 314.

The flanges 314 rest against the wall surfaces 22; they are not set off from them. The profiles of the sidewalls 302, 304 leave very little space between the sidewalls 302, 304 and the slot. However, the grooves 316 at the joints between the sidewalls 302, 304 and their respective flanges 314 are large and ellipsoid. Additionally, the outer surface of each sidewall 302, 304 has several large, ellipsoid flutes to allow for a joint compound or another such adhesive.

The bottom 306 of the channel 300 also differs from previous embodiments. As was noted above, one advantage of modular channel design is that the channels 10, 100, 200, 250, 300 can be of any width, depending on the width of the particular channel bottom 306 that is used. The channel 300 of FIG. 7 uses a wider base 306 than some of the other illustrated embodiments, and its shape is different. Specifically, the longitudinal centerline of the bottom 306 is marked with a groove 322. On both sides of the groove 322, in mirror-image fashion, the bottom 306 has a roughly trapezoidal shape, such that the side edges of the bottom 306 rise higher than the center.

A bottom 306 with a particular shape can be used to direct the light from a strip of linear lighting 50, essentially by pointing the LED light engines 52. As will be described in more detail below, this can be used in cooperation with a particular type of lens-cover 312 to create a particular optical effect. In the illustrated embodiment, two strips of linear lighting 50 are mounted on the bottom 306, the light they produce directed slightly inward, toward the center of the cover 312. In other embodiments, additional strips of linear lighting 50 may be placed on the sidewalls 302, 304.

Covers for Channels and Diffusion of Light

In addition to allowing a great deal of variation in the overall shape and sizes of channels for linear lighting, the kind of modular construction described here also allows for a great deal of variation in the types of covers that can be used, which provides for a number of options for photon herding, i.e., managing and directing the light output of the linear lighting that is installed in the channel. The following provides a description of some of the specific optical features of channels and channel-cover combinations according to embodiments of the invention. Although the construction of the channels described here is modular, it should be understood that many of the effects described here can be achieved with single-piece channels as well.

In embodiments of the present invention, as was noted above, the primary objective of most covers is to provide diffusion. "Diffusion," as that term is used here, refers to the spreading or scattering of transmitted or reflected beams of light, typically by transmission through a non-uniform medium or refraction at a non-uniform surface or interface. Diffusion gives the light emerging from a channel a uniform appearance and, preferably, reduces the prominence of the individual spots of light created by the LED light engines. A typical diffusing cover is at least somewhat opaque—filled with a colorant or dye that causes light scattering. In some cases, covers according to embodiments of the invention may have the attributes of lenses or prisms, typically to add to the diffusion by spreading the light, although the selectively thickened portions of lenses or prisms may also provide for greater diffusion simply because the light must pass through more material. Lenses or prisms may also be used to direct the light in some embodiments, or to establish a particular beam angle, and may or may not be opaque. The term "lens," as used in this description, refers to an element with at least one curved surface that is intended to refract and direct light. The term "prism," as used in this description, refers to an element with flat, angled sides that is intended to refract and direct light.

The channel covers in embodiments of the invention may be made of any suitable material. Suitable materials, in this context, are materials that are at least translucent. For example, the channel covers may be made of a plastic, such as polycarbonate or acrylic, or they may be made of glass.

In the channel 10 of FIGS. 1-3, the cover 18 is a prism with a hexagonal cross-sectional shape. The cover 18 has two long sides, angularly offset from one another, on the interior and the exterior of the channel. Covers such as the cover 18 of this embodiment may spread the light from the linear lighting 18 in two different directions, depending on the angles formed by the sides of the cover 18, the position of the linear lighting 50 within the channel 10, and other factors.

In order to retain the cover 18, the sidewalls 12, 14 rise slightly beyond the flanges 20. The cover 18 is held by the sidewalls 12, 14 and rests on slight, rounded inward ridges 46 formed in the upper portion of the sidewalls 12, 14.

Because of its shape, the cover 18 of FIGS. 1-3 is angled on its exterior face. In some cases, it may be preferable to have a flat, or mostly flat, outer surface and to place angled or curved light-directing surfaces within the channel. The cover 112 of the channel 100 of FIG. 4 illustrates this principle: it is nearly flat on its exterior surface, with two angled faces meeting at a point within the channel 100.

The cover 112 and the channel 100 also have a slightly different mode of engagement. In the channel 10 of FIGS. 1-3, the interior sidewalls 12, 14 have male structure—the ridges 46—that holds the cover 18. By contrast, the channel 100 has female structure, specifically recessed grooves 150, for holding the cover 112. The cover 112 flares out into complementary ridges 152 to engage the sidewalls 106, 108.

Figure 8:
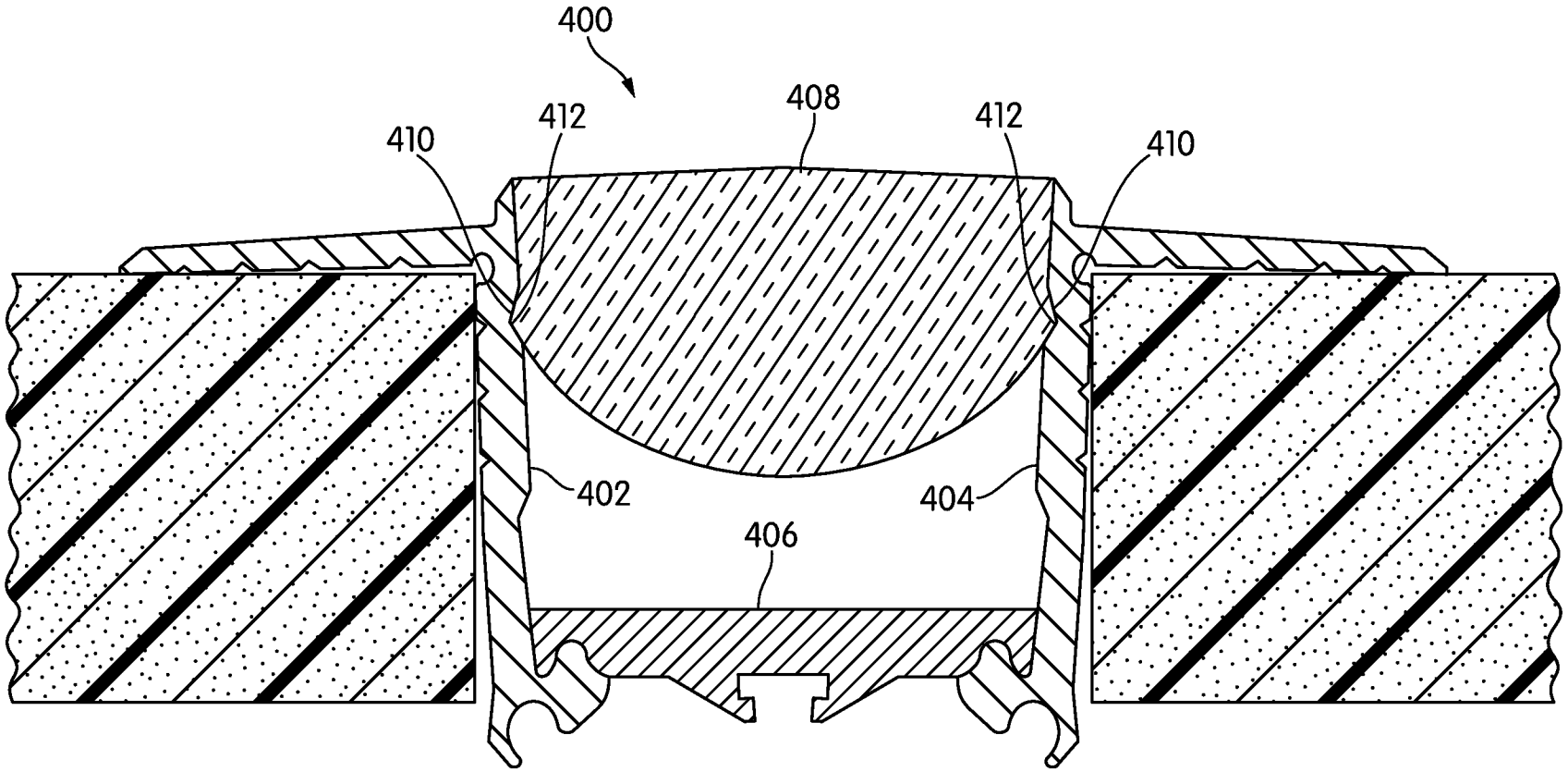
FIG. 8 is a cross-sectional view of a channel according to another further embodiment of the invention.

FIG. 8 is a cross-sectional view of a channel, generally indicated at 400, that serves as another illustration of this principle. Specifically, the sidewalls 402, 404 and bottom 406 support a cover 408 that has the form of an inverted plano-convex lens, with the convexity facing the bottom 406. Like the channel 100 described above, each sidewall 402, 404 has a groove 410. The cover 408 forms complementary projecting structure 412 that flares into the grooves 410 to secure the cover 408. The convex portion of the cover 408 consumes a considerable amount of space within the channel 400.

As was described above, a typical goal in using a cover 18, 112 is to emit light evenly over the entire surface of the cover 18, 112, with as little shadow as possible. In some cases, the structures used to capture and retain the cover 18, 112 can create shadows or gaps where light cannot reach. For that reason, it can be helpful to create sidewall profiles that can capture and retain a cover, but are less likely to create shadows or light gaps.

The channel 250 and cover 258 of FIG. 6 are a good example of this principle. The cover 258 is trapezoidal in overall cross-sectional shape, with top and bottom surfaces that are nearly flat. The flat upper and lower surfaces of the cover 258 mean that it would generally have very little light-focusing or light-directing effect, but would serve as a diffuser, particularly if partially opaque. The sides of the cover 258 broaden toward the interior of the channel 250. The sidewalls 252, 254 do not include any projections, ridges, or other inwardly-extending structure that would tend to block light emitted by the linear lighting 50 from reaching the cover 258 and exiting the channel 250. Instead, the tops of the sidewalls 252, 254 have a negative draft, i.e., they cant inwardly to engage the angled side faces of the cover 258. The interior bends 255 formed by the tops of the sidewalls 252, 254 help to retain the cover 258. As can be seen in FIG. 6, the interior profiles of the sidewalls 252, 254 are otherwise featureless down to the level of the bottom 256.

Figure 9:
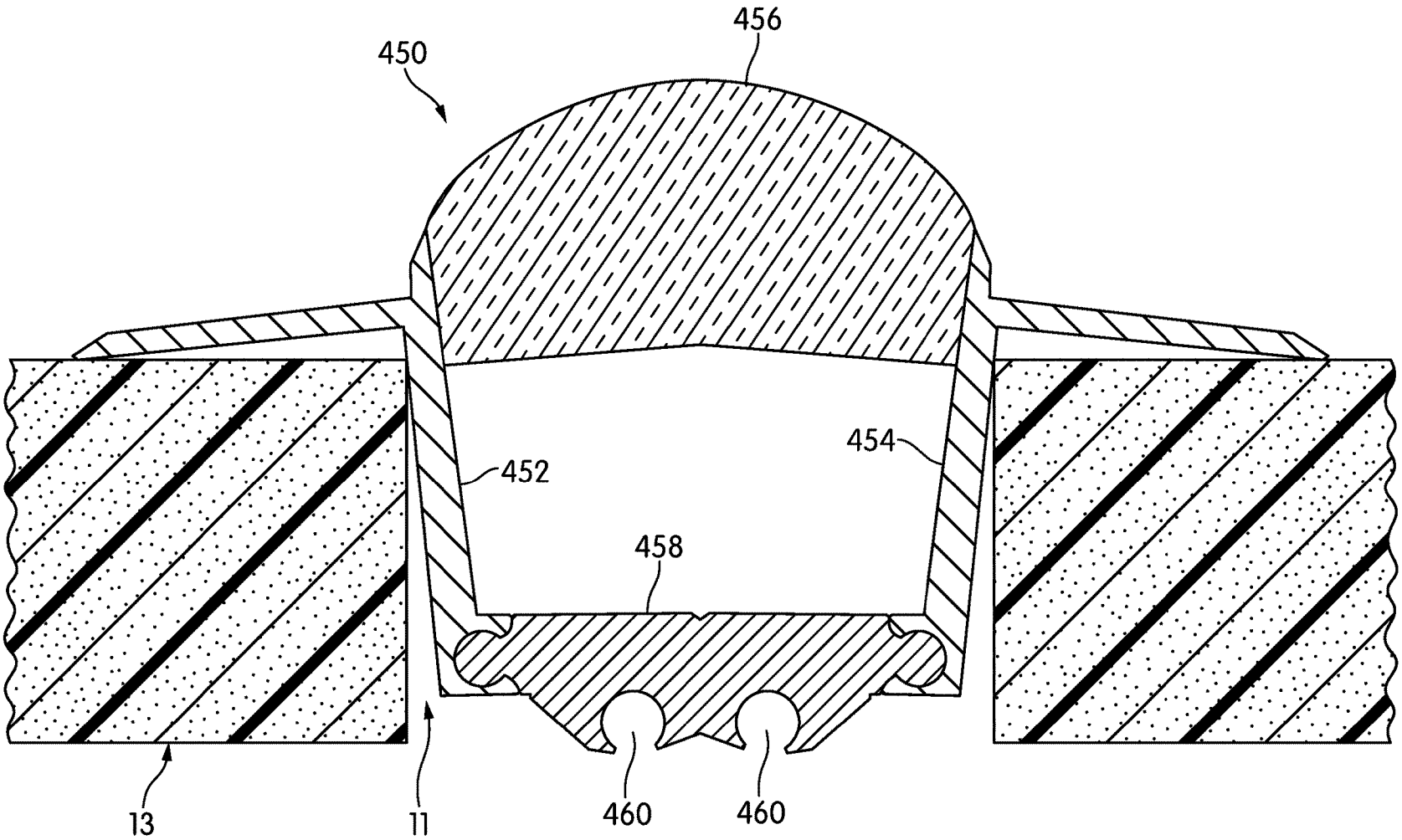
FIG. 9 is a cross-sectional view of a channel according to yet another further embodiment of the invention.

FIG. 9 is a cross-sectional view of another channel, generally indicated at 450, according to another embodiment of the invention. More specifically, the sidewalls 452, 454 of the channel 450 are angled outwardly with respect to vertical (in the view of FIG. 9), leaving a gap between the outer surfaces of the sidewalls 452, 454 and the slot. In this case, the interior surfaces of the sidewalls 452, 454 are straight, without projections, steps, recesses, or other structure. The cover 456, which is a plano-convex lens, has its convex side facing outwardly. Unlike in other embodiments, there is no specific structure, either on the cover 456 or the sidewalls 452, 454 that engages the two; rather, the fit is a tight or frictional fit.

The base 458 of the channel 450, which engages the sidewalls 452, 454 by a rounded tab-and-slot arrangement, is thicker than the bottoms of some of the other embodiments described above, and defines two channels 460 within its thickness. The two channels 460 are round and open downward. They may be used either for alignment pins to attach adjacent sections of channel 450, or they may be used to attach to external surfaces.

The above description gives many examples of joint structure. The particular structure that is used to join the parts of a channel in embodiments of the present invention may vary according to a number of factors, including the forces that are to be applied to the channel during and after installation and their directions, the method by which the channel parts are to be made and any limitations imposed by that method, and the degree of ingress protection or water resistance required at the joint. With respect to ingress protection, the requirement for a sealed joint, or a joint with a high ingress-protection rating, can be lessened by using linear lighting that is encapsulated.

Multi-Purpose Channels

Each of the channels described above has flanges for flush mounting in a wall. However, that need not be the case in all embodiments. Not all channels according to embodiments of the invention need be equipped for flush mounting in a wall. In many embodiments, it may be helpful to have a channel that can be converted for either in-wall use or mounting in some other fashion. For that reason, the components that adapt the channel for in-wall use, e.g., the flanges 20, may themselves be modular.

Figure 10:
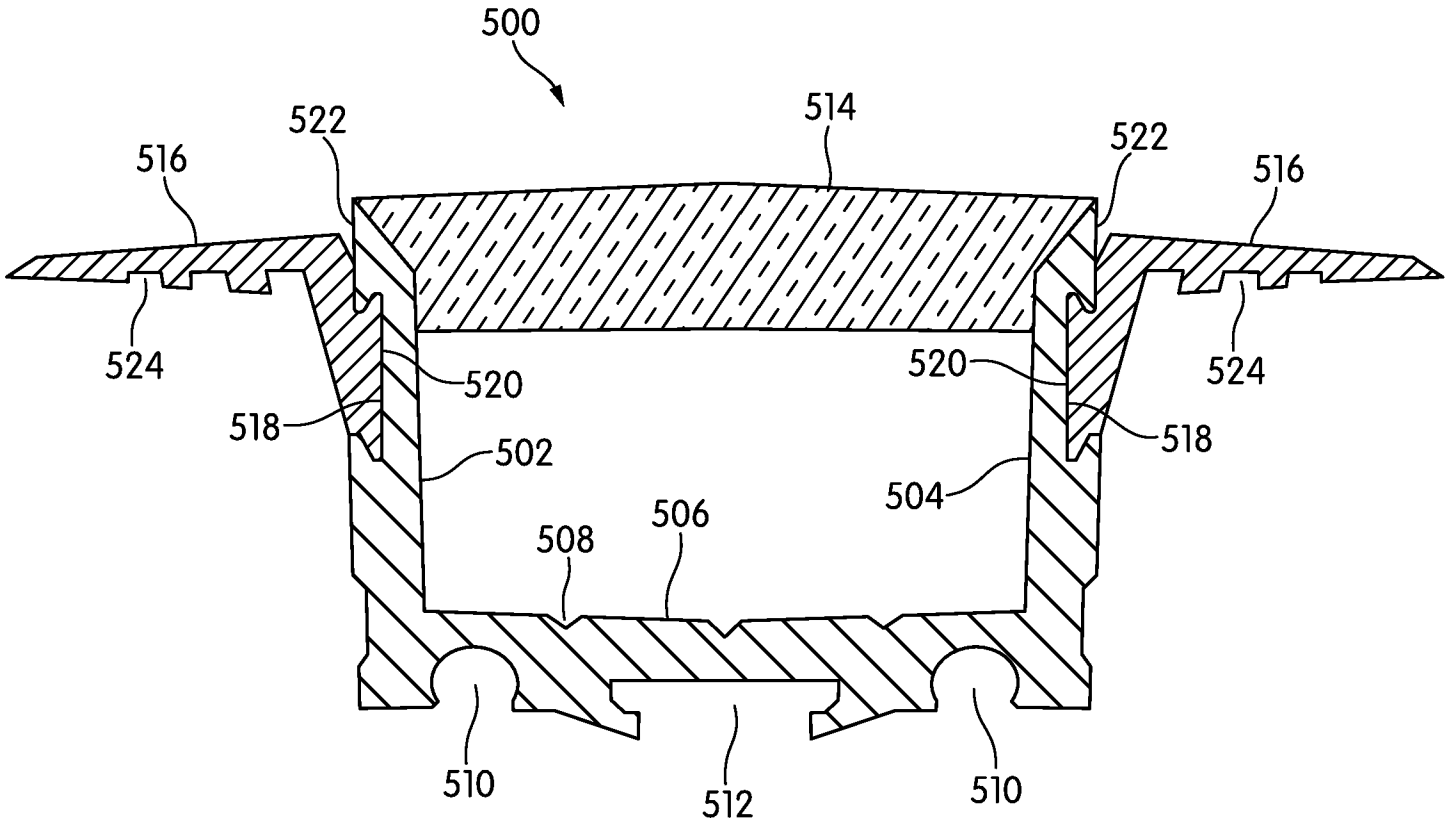
FIG. 10 is a cross-sectional view of a multi-purpose channel according to another embodiment of the invention.

FIG. 10 is a cross-sectional view of a multi-purpose channel, generally indicated at 500, according to another embodiment of the invention. The multi-purpose channel 500 of FIG. 10 features a single, generally U-shaped piece that forms sidewalls 502, 504 and a bottom 506, although in other embodiments, the channel 500 may have modular, separable sidewalls and a bottom. Internally, the sidewalls 502, 504 of the illustrated embodiment are straight and vertical (in the orientation of FIG. 10). The bottom 504 has grooves 508 for alignment, and on its underside carries rounded, semicircular channels 510, one on each side of the centerline, that may be used for alignment pins or for attachment to other mounting structure. On center, the bottom 506 carries a generally T-shaped slot 512 in its underside that provides for attachment to mounting structure for additional support along the length of the channel 500, if needed. The tops of the sidewalls 502, 504 are cut down diagonally to come to sharp peaks at their outer edges. The cover 514 has a lower portion with a rectangular cross-section and flares out trapezoidally at the point where the sidewalls 502, 504 are cut down triangularly. As can be seen in FIG. 10, there are no internal ridges or projections to retain the cover 514; the shape of the tops of the sidewalls 502, 504 and the corresponding shape of the cover 514 retain the cover 514 in engagement with the sidewalls 502, 504. The channel 500 may be extruded, machined, molded, or made by any other manufacturing method.

In the channel 500 of FIG. 10, the flanges 516 are modular and removable from the sidewalls 502, 504 and bottom 506. Specifically, they make a dovetail joint with the body of the channel 500, a portion of each flange 516 extending downwardly and flaring into a roughly trapezoidal tenon 518, with the corresponding mortise being a slot 520 of corresponding shape in the outer aspect of each sidewall 502, 504. The connection between the channel 500 and the sidewall 502, 504 is a slide-in connection, although snap-fit and other types of connections may be used in other embodiments. The flanges 516 can thus be installed or removed in the channel 500 if needed. Otherwise, the channel 500 can be mounted to an external surface using the other structure 510, 512 that is provided.

The flanges 516 are mounted in roughly the same position, relative to the tops of the sidewalls 502, 504, as in the modular channels described above, with a small vertical lip 522 between the tops of the flanges 516 and the tops of the sidewalls 502, 504. The undersides of the flanges 516 carry flutes 524.

While two flanges 516 are used in the embodiment of FIG. 10, embodiments of the invention may use only one flange 516, or may use two flanges of different types, widths, etc. For example, one flange 516 may be used instead of two when the channel 510 is mounted near an edge or corner of a wall. It should also be understood that while the slots 520 are illustrated in FIG. 10 as being used to mount the flanges 516, the slots 520 may be used to secure other types of mounting hardware as well.

Figure 11:
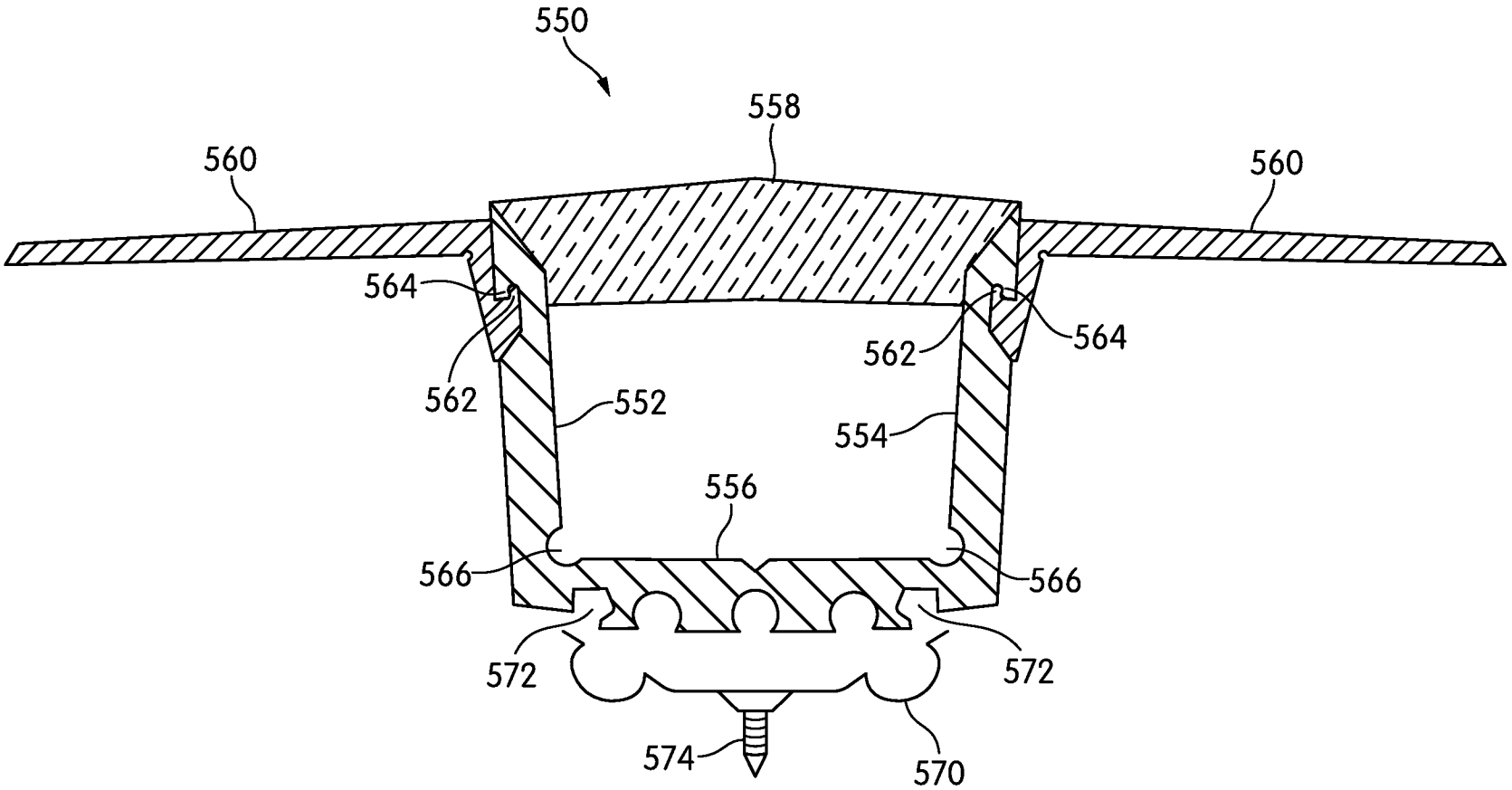
FIG. 11 is a cross-sectional view of a multi-purpose channel according to yet another embodiment of the invention, illustrating the channel with a mounting clip.

FIG. 11 is a cross-sectional view of a channel, generally indicated at 550, that represents a variation on this concept. The channel 550, like the channel 500 described above, is of single-piece construction, U-shaped with sidewalls 552, 554 and a bottom 556. The arrangement of the cover 558 and the tops of the sidewalls 552, 554 is similar to that described above with respect to the channel 500 of FIG. 10.

The flanges 560 carry upwardly-projecting male structure 562 that fits into a complementary slot 564 in each sidewall 552, 554. Thus, the connection between the flange 560 and the sidewall 552, 554 is also a slide-in connection, albeit one of a different type than that described above with respect to the channel 500 of FIG. 10. As was described above with respect to modular channels, the precise type of joint structure that is used will vary according to a number of factors.

The channel 550 also includes internal channels or grooves 566 at the bases of the sidewalls 552, 554, where they join the bottom 556. As those of skill in the art will appreciate, the ends of channel 550, and more generally, of channels according to embodiments of the invention, are typically closed off with endcaps of some variety. The endcaps are usually stamped, machined, or molded, depending on whether they are made of metal or plastic. Typically, the fit between the channel and the endcaps is a tight fit, and may be an interference fit in some cases. If the fit is not tight enough for the endcaps to remain in position, then adhesive may be used.

The grooves 566 along the bottom interior of the channel 550 provide engaging structure for endcaps. The endcaps may have pegs that project into the grooves 566. Of course, simply because a channel has a particular structure or feature does not mean that that structure or feature must be used in any particular application or installation; rather, features may be provided simply for the sake of versatility. Endcaps of any configuration may be used with the channel 550 and others according to embodiments of the invention, so long as those endcaps adequately perform the necessary function. Moreover, no particular structure is necessarily limited to a single purpose: the grooves 566 may also be used in some cases as internal raceways for wires.

FIG. 11 also illustrates a mounting clip 570 that attaches to the underside of the channel 550 by way of grooves 572 carried on each side of the centerline. The mounting clip 570 carries openings that allow it to be fastened down to a surface, and a fastener 574 is shown in FIG. 11 for that purpose.

In the channels 500, 550 described above, when installed, the flanges 516, 560 fall in roughly the same position and serve the same function. However, that need not be the case in all embodiments. Flanges on a channel may serve a number of functions, and may be attached in a number of different positions.

Figure 12:
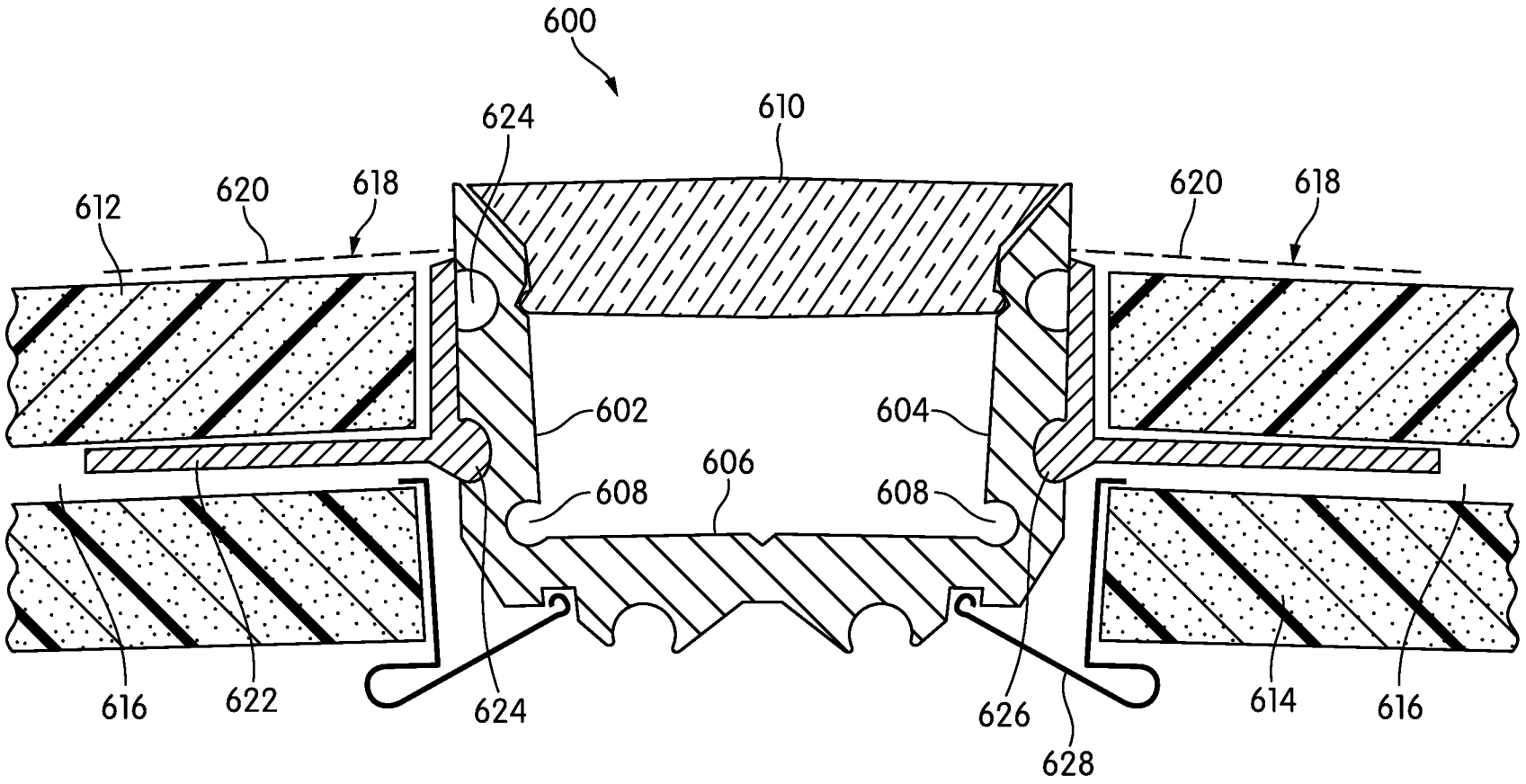
FIG. 12 is a cross-sectional view of a multi-purpose channel according to a further embodiment of the invention.

FIG. 12 is a cross-sectional view of another modular channel, generally indicated at 600, according to another embodiment of the invention. The single piece channel 600 has many of the features of the other embodiments, including single-piece sidewalls 602, 604 and a bottom 606. The interior of the channel 600 includes grooves 608 at its bottom corners to seat endcaps or other structure, and the cover 610 and tops of the sidewalls 602, 604 have the same shape as described above with respect to the channel 500 of FIG. 10.

The channel 600 of FIG. 12 is installed somewhat differently than the other channels 500, 550. Specifically, the channel 600 is flush-mounted, but the structure to which it is mounted has two layers 612, 614 with an open space 616 between them. The channel 600 has a pair of flanges 618, one on each side. However, these flanges 618 are C-shaped, with a portion 620 that sits flush adjacent to the channel on the upper surface 612 and a portion 622 that sits in the open space 616. The flanges 618 attach to the channel 600 differently as well—the channel 600 has two rounded, semi-circular grooves 624 along its exterior. The flange 618, which has corresponding rounded structure 626, rests in the lower of the two grooves 624 in the illustration of FIG. 12.

The engagement of the channel 600 with its flanges 618 is thus not as interlocking as the engagement in some other embodiments. However, the flanges 618 are still able to bear at least a portion of the weight of the channel 600. Clips 628 support another portion of the weight of the channel 600. In addition to bearing weight, the flanges 618 may also stabilize the channel 600 in its mounting space.

While the invention has been described with respect to certain embodiments, the description is intended to be exemplary, rather than limiting. Modifications and changes may be made within the scope of the invention, which is defined by the appended claims.

What is claimed is:

1. A channel, comprising:

a pair of sidewalls, each sidewall having a top forming a free edge of the sidewall, a sidewall bottom spaced from the top, and an engaging structure formed in the sidewall at, in, or proximate to the sidewall bottom; and a channel bottom, the channel bottom adapted to extend between the pair of sidewalls to create a three-sided channel, each side of the channel bottom carrying a complementary engaging structure adapted to engage the engaging structures of the pair of sidewalls to form a joint between each sidewall and the bottom, the three-sided channel having an upwardly opening, generally cup-shaped configuration with an opening formed between the free edges of the sidewalls that is adapted to receive therein a channel cover.

2. The channel of claim 1, further comprising an intermediate member in the joints between the pair of sidewalls and the channel bottom such that the pair of sidewalls and the channel bottom each contact the intermediate member at each of the joints.

3. The channel of claim 2, wherein the intermediate member comprises a plastic or rubber of constant cross-sectional shape.

4. The channel of claim 3, wherein the intermediate member comprises a tube.

5. The channel of claim 3, wherein the cross-sectional shape of the intermediate member is round or ellipsoid.

6. The channel of claim 1, wherein the engaging structures of the pair of sidewalls and the complementary engaging structures of the channel bottom are constructed and arranged to be brought into engagement by pushing or snapping together.

7. The channel of claim 1, wherein the engaging structures of the pair of sidewalls and the complementary engaging structures of the channel bottom are constructed and arranged to be brought into engagement by sliding together.

8. The channel of claim 7, wherein the engaging structures and the complementary engaging structures comprise tabs and corresponding slots.

9. The channel of claim 1, wherein the channel bottom has a generally flat upper surface.

10. The channel of claim 1, wherein the channel bottom has a sloped upper surface.

11. The channel of claim 1, wherein the channel bottom carries at least one groove or channel in or on a lower portion thereof.

12. The channel of claim 11, wherein the channel bottom carries at least one pair of grooves or channels in the lower portion, the grooves or channels of the at least one pair spaced equidistant from one another about a centerline of the channel bottom.

13. The channel of claim 1, wherein the engaging structures of the pair of sidewalls are positioned above the sidewall bottoms, such that when the channel is assembled, a raceway space is defined between an underside of the channel bottom and the sidewall bottoms.

14. The channel of claim 1, wherein each of the pair of sidewalls further comprises a flange that extends outward from the sidewall near the free edges thereof.

15. The channel of claim 14, wherein each of the pair of sidewalls further comprises:

one or more flutes on an outer side thereof;

one or more flutes on an underside of the flange; and a groove at the junction between the sidewall and the flange.

16. The channel of claim 14, further comprising a ridge on an underside of each of the flanges, the ridge positioned proximate to the sidewall.

17. The channel of claim 1, wherein each of the pair of sidewalls thickens from the top toward the sidewall bottom.

18. The channel of claim 17, wherein the engaging structures are internal to the pair of sidewalls.

19. The channel of claim 1, wherein the pair of sidewalls extend at generally right angles to the channel bottom.

20. The channel of claim 1, wherein the pair of sidewalls diverge outwardly from the channel bottom.

21. A luminaire, comprising:

a channel, including a pair of sidewalls, each sidewall having a top forming a free edge of the sidewall, a sidewall bottom spaced from the top, and an engaging structure formed in the sidewall at, in, or proximate to the sidewall bottom, and a channel bottom, the channel bottom adapted to extend between the pair of sidewalls to create a three-sided channel, each side of the channel bottom carrying a complementary engaging structure adapted to engage the engaging structures of the pair of sidewalls to form a joint between each sidewall and the bottom, the three-sided channel having an upwardly opening, generally cup-shaped configuration with an opening formed between the free edges of the sidewalls that is adapted to receive therein a channel cover;

at least one strip of linear lighting disposed in the channel; and a channel cover disposed within the opening and engaged with the channel at the tops of the pair of sidewalls, thereby covering the channel.

* * * * *